US007400083B2

(12) United States Patent
Yaguchi et al.

(10) Patent No.: US 7,400,083 B2
(45) Date of Patent: Jul. 15, 2008

(54) FLAT PANEL DISPLAY DEVICE INCLUDING ELECTRON BEAM SOURCES AND CONTROL ELECTRODES

(75) Inventors: Tomio Yaguchi, Sagamihara (JP); Takahiko Muneyoshi, Musashimurayama (JP); Makoto Okai, Tokorozawa (JP); Nobuaki Hayashi, Kunitachi (JP); Tomoki Nakamura, Chiba (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 458 days.

(21) Appl. No.: 10/937,329

(22) Filed: Sep. 10, 2004

(65) Prior Publication Data

US 2005/0057178 A1 Mar. 17, 2005

(30) Foreign Application Priority Data

Sep. 11, 2003 (JP) ..... 2003-319294

(51) Int. Cl.

| | |
|---|---|
| ***H01J 1/62*** | (2006.01) |
| ***H01J 63/04*** | (2006.01) |
| ***H01J 1/46*** | (2006.01) |
| ***H01J 21/10*** | (2006.01) |

(52) U.S. Cl. ..... 313/495; 313/497; 313/293; 313/304

(58) Field of Classification Search ..... 313/495–497
See application file for complete search history.

(56) References Cited

U.S. PATENT DOCUMENTS

| | | | | |
|---|---|---|---|---|
| 5,144,191 | A * | 9/1992 | Jones et al. | 313/308 |
| 5,191,217 | A * | 3/1993 | Kane et al. | 250/423 F |
| 6,037,708 | A * | 3/2000 | Potter | 313/310 |
| 7,259,511 | B2 * | 8/2007 | Yaguchi et al. | 313/497 |
| 2004/0080260 | A1 * | 4/2004 | Park et al. | 313/495 |
| 2004/0195956 | A1 * | 10/2004 | Minami | 313/495 |

* cited by examiner

*Primary Examiner*—Mariceli Santiago
(74) *Attorney, Agent, or Firm*—Antonelli, Terry, Stout & Kraus, LLP.

(57) ABSTRACT

Using a cathode material with which an electron emission having sufficient intensity is obtained with a low electric field, over a back substrate, cathodes and first control electrodes are formed on the same plane, which is parallel to the back substrate, thus forming electron beam sources, and second control electrodes, which focus electrons taken out from the electron beam sources, are formed, whereby it is possible to obtain an image display of high brightness.

3 Claims, 6 Drawing Sheets

FLAT PANEL DISPLAY DEVICE INCLUDING ELECTRON BEAM SOURCES AND CONTROL ELECTRODES

BACKGROUND OF THE INVENTION

The present invention relates to a flat panel display device of the type which includes electron beam sources having electron sources (cathodes) which emit electrons in response to an electric field and a phosphor screen which is excited by electron beams emitted from the electron beam sources, and, more particularly, the invention relates to a flat panel display device which is capable of producing an image display of high definition by focusing electron beams on a phosphor screen.

Recently, a field-emission-type flat panel display device has been developed which uses diamond, carbon nanotubes or the like as the material for electron sources which emit electrons in response to a low electric field. These electron sources will be referred to as cathodes hereinafter. This type of cathode can obtain a sufficient emission of electrons in response to an extremely low electric field compared with conventional field-emission-type cathodes which use a metal material as a main material. The flat panel display device which uses such an electron emission material as a cathode is disclosed in Japanese Unexamined Patent Publication 2000-268706 (patent literature 1) and Japanese Unexamined Patent Publication 2002-25478 (patent literature 2), for example. The flat panel display device described in these publications is a kind of cathode tube in which a back panel and a face panel have respective main surfaces which face each other in an opposed manner, and the peripheries of these panels are sealed by a sealing frame and a vacuum is created in the inside of the sealed structure. Here, the back panel has a so-called in-plane-gate (hereinafter abbreviated as IPG) structure in which cathodes operating as electron beam sources and control electrodes are formed on the same plane of a main surface of a back substrate which constitutes a first substrate, while the face panel includes a phosphor screen to which phosphors are applied to a main surface of a face substrate which constitutes a second substrate.

In the flat panel display device having the electron beam sources of the IPG structure, to effectively excite the phosphors with the electron beams from the electron beam sources, it is effective to provide focusing electrodes. To provide focusing electrodes to the back substrate of IPG structure, it is necessary to provide focusing electrode lines in addition to control electrode lines which supply electricity to the control electrodes. Japanese Unexamined Patent Publication 2000-3664 (patent literature 3) discloses a flat panel display device which includes electron sources of the Spindt structure and electron beam sources formed of control electrodes, wherein focusing electrodes having a partition-wall shape which surround respective pixel regions are formed over the electron beam sources, and the focusing electrodes are connected with control electrode lines of neighboring pixels.

SUMMARY OF THE INVENTION

However, as described in patent literature 1 and patent literature 2, in a flat panel display device having only control electrodes, it is difficult to individually control both the intensity and the focusing property of the electron beams. Further, in a flat panel display device as disclosed in patent literature 3, on the back substrate having the electron beam sources, the focusing electrodes are formed so as to project in the phosphor screen direction in a state in which the focusing electrodes surround the electron beams which are taken out from the electron beam sources, and these focusing electrodes are directly or indirectly connected with control electrode lines with respect to which the focusing electrodes are closely arranged. However, in the electron beam sources of IPG structure, it is necessary to provide spaces for arranging the focusing electrodes and to provide pull-around lines around the electron beam sources; and, hence, the width of the control electrodes becomes inevitably narrow, whereby it is difficult to form control electrode lines and to connect the focusing electrodes with the control electrodes in a flat panel display device having electron beam sources of the IPG structure.

Accordingly, it is an object of the present invention to provide a flat panel display device which adopts a structure in which focusing electrodes are provided, which cover upper layers of electron beam sources of IPG structure, having cathodes and control electrodes arranged on the same plane of a back substrate (hereinafter referred to as the same plane), and in which openings for respective pixels are provided, or in which the focusing electrodes are formed on the same plane as the electron beam sources of IPG structure, and the focusing electrodes are connected to focusing electrode lines which are formed on a plane different from the surface of the back substrate on which the electron beam sources are formed, thus enabling an image display of high quality by efficiently exciting phosphors by focusing electron beams from the electron beam sources.

To achieve the above-mentioned object, the present invention is characterized by the following constitutions.

(1) In a flat panel display device which includes a back panel having a back substrate, a face panel having a face substrate, and a sealing frame which laminates peripheries of a display region formed at center portions of opposing faces of main surfaces of the back panel and the face panel and seals a lamination gap, the flat panel display device further includes:

a plurality of electron beam sources which are constituted of a plurality of cathode lines, which are formed on a first plane parallel to the main surface of the back substrate, have cathodes that extend in a first direction and are arranged in parallel in a second direction which intersects the first direction; first control electrodes which are arranged close to the cathode lines at least within the display region and control the takeout quantity of electrons from the cathodes; and second control electrodes which are formed on a second plane parallel to the first plane and are positioned on the face panel side, and have openings in portions (pixel portions) thereof corresponding to the electron beam sources and focus electron beams taken out from the electron beam sources in the direction toward the face panel.

Further, the above-mentioned second control electrodes may be formed such that an upper insulation layer is interposed between the second control electrodes and the first control electrodes.

Further, according to the present invention, the flat panel display device includes first control electrode lines which are formed below the main surface of the back substrate and the first plane by way of a lower insulation layer, and the first control electrodes are electrically connected with the first control electrode lines via through holes which penetrate the lower insulation layer.

Further, according to the present invention, the flat panel display device further includes:

a plurality of electron beam sources constituted of a plurality of cathode lines which are formed on a plane parallel to the main surface of the back substrate and have cathodes thereon, and which extend in a first direction and are arranged in parallel in a second direction which intersects the first direction; first control electrodes which are arranged close to the cathode lines at least within the display region and which control the takeout quantity of electrons from the cathodes; and second control electrodes which are positioned in the second direction with respect to the electron beam sources and focus electron beams taken out from the electron beam sources in the direction of the face panel.

Further, the flat panel display device includes first control electrode lines which are formed on the main surface of the back substrate and below the plane by way of an insulation layer in a state such that the first control electrode lines extend in the second direction and are arranged in parallel in the first direction, and the first control electrodes are electrically connected with the first control electrode lines via first through holes which penetrate the insulation layer.

Further, according to the present invention, the flat panel display device includes second control electrode lines which are formed on the main surface of the back substrate by way of the insulation layer in a state such that the second control electrode lines extend in the second direction and are arranged in parallel in the first direction, and the second control electrodes are electrically connected with the second control electrode lines via second through holes which penetrate the insulation layer and are electrically insulated from the first control electrode lines. Further, the flat panel display device may be configured such that portions of the second control electrodes surround the electron beam sources from the first direction.

Further, the present invention is characterized by the following constitutions.

(2) In a flat panel display device which includes a back panel having a back substrate, a face panel having a face substrate, and a sealing frame which laminates the peripheries of a display region formed at center portions of opposing faces of the main surfaces of the back panel and the face panel and seals a lamination gap formed therebetween, the flat panel display device further includes:

a plurality of electron beam sources which are constituted of a plurality of cathode lines, which are formed on a plane parallel to the main surface of the back substrate, have cathodes, extend in a first direction and are arranged in parallel in a second direction which intersects the first direction; first control electrodes which are arranged close to the cathode lines at least within the display region and control the takeout quantity of electrons from the cathodes; and second control electrodes which are positioned in the second direction with respect to the electron beam sources and focus electron beams taken out from the electron beam sources in the direction toward the face panel.

Further, the second control electrodes are constituted of a plurality of second control-electrode division electrodes which are divided in the first direction with respect to each electron beam source, and a first connection portion (an inter-control-electrode connection line), which electrically connects the neighboring first control electrodes to each other in the second direction, is provided between the divided second control-electrode division electrodes.

Further, according to the present invention, the flat panel display device includes first control electrode lines which are formed on the main surface of the back substrate and below the plane by way of an insulation layer in a state such that the first control electrode lines extend in the second direction and are arranged in parallel in the first direction, and the first control electrodes are electrically connected with the first control electrode lines via first through holes which penetrate the insulation layer and are formed at portions of the first inter-control-electrode connection lines.

Further, according to the present invention, the flat panel display device includes second control electrode lines which are formed on the main surface of the back substrate by way of the insulation layer in a state such that the second control electrode lines extend in the second direction and are arranged in parallel in the first direction, and the second control electrodes are electrically connected with the second control electrode lines via second through holes which penetrate the insulation layer and are electrically insulated from the first control electrode lines.

Further, the present invention is characterized by the following constitutions.

(3) In a flat panel display device which includes a back panel having a back substrate, a face panel having a face substrate, and a sealing frame which laminates the peripheries of a display region formed at center portions of opposing faces of main surfaces of the back panel and the face panel and seals a lamination gap formed therebetween, the flat panel display device further includes:

a plurality of electron beam sources which are constituted of a plurality of cathode lines which are formed on a plane parallel to the main surface of the back substrate, have cathodes, extend in a first direction and are arranged in parallel in a second direction which intersects the first direction; first control electrodes which are arranged close to the cathode lines at least within the display region and control the takeout quantity of electrons from the cathodes and second control electrodes which are positioned in the second direction with respect to the electron beam sources and which focus electron beams taken out from the electron beam sources in the direction toward the face panel, wherein the first control electrodes are configured to be electrically connected with the second control electrodes to which the first control electrodes are closely arranged in the first direction.

Further, according to the present invention, the flat panel display device includes second control electrode lines which are formed below the main surface of the back substrate and the plane by way of an insulation layer, and the second control electrodes are electrically connected with the second control electrode lines via through holes which penetrate the insulation layer.

Further, according to the present invention, in the above-mentioned respective constitutions, it is possible to provide a plurality of partition walls between the back panel and the face panel. Still further, according to the present invention, the cathodes are formed of an electron emission material which directly emits electrons in a vacuum and the electron emission material may be any one of carbon nanotubes, fine carbon fibers, diamond, diamond-like carbon each of which contains carbon, as a main component.

It is needless to say that the present invention is not limited to the above-mentioned respective constitutions and the constitutions described in conjunction with the embodiments to be explained later, and various modification are conceivable within the technical concept of the present invention.

As has been explained heretofore, according to the present invention, by adopting a structure in which the cathode material, such as carbon nanotubes, which can obtain the required electron beam intensity even when a relatively low electric field of several V/μm is used, electron beams which are emitted based on an electric field between the anode and the cathode are controlled using the first control electrodes, and the electron beams are focused by the second control electrodes and are directed to the phosphor screen, it is possible to provide a flat panel display device of high brightness which can be driven with a low voltage.

DESCRIPTION OF THE PREFERRED EMBODIMENTS

Preferred embodiments of the present invention explained in detail hereinafter in conjunction with the drawings.

Figure 1:
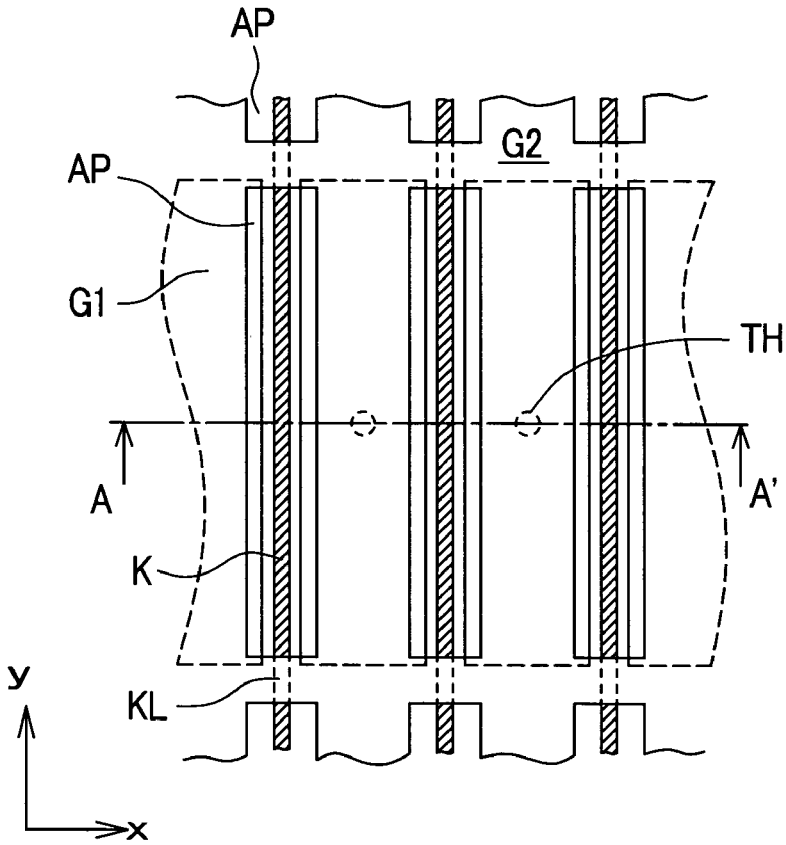
FIG. 1 is a diagrammatic plan view of a representative portion of a first embodiment of a flat panel display device according to the present invention.
Figure 2:
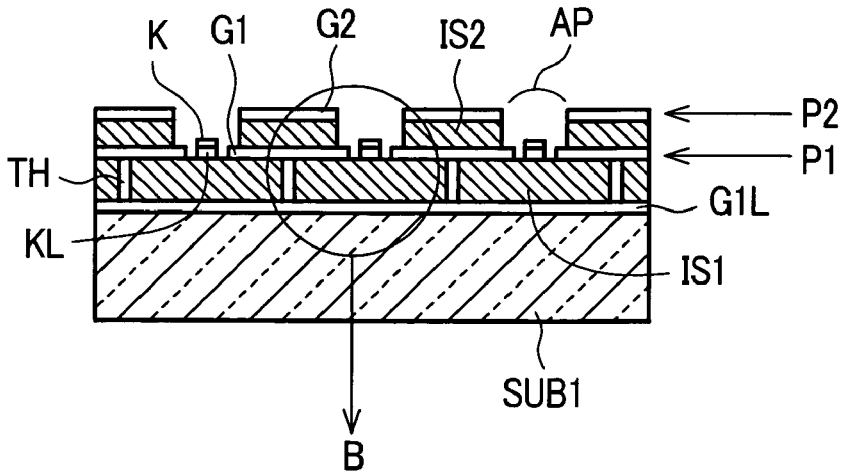
FIG. 2 is a cross-sectional view taken along a line A-A' in FIG. 1.
Figure 3:
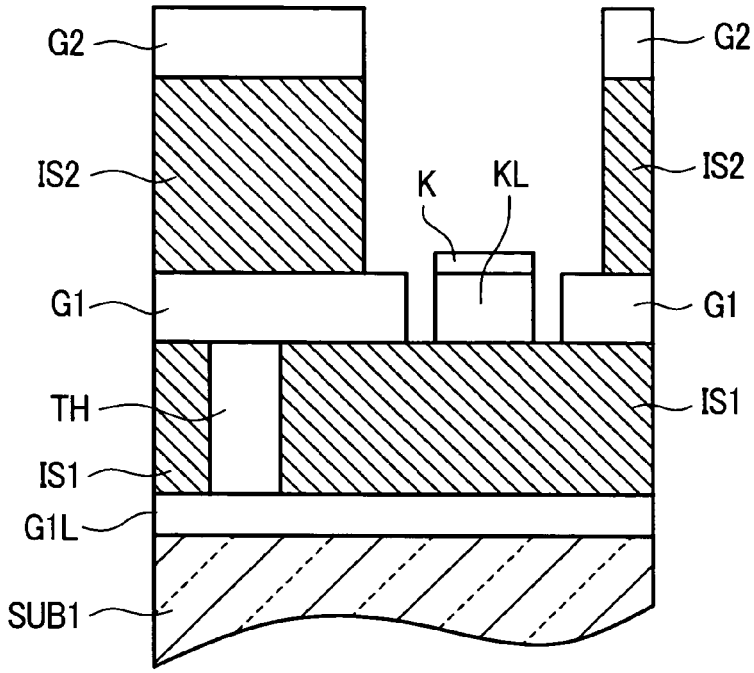
FIG. 3 is an enlarged view of a portion B in FIG. 2.

FIG. 1 is a plan view of a first embodiment of a flat panel display device according to the present invention, FIG. 2 is a cross-sectional view taken along a line A-A' in FIG. 1, and FIG. 3 is an enlarged view of a portion B in FIG. 2. FIG. 1 to FIG. 3 show only a back panel, and the face panel is omitted from the drawings.

Here, only a portion consisting of three pixels (each pixel forming a sub pixel in a color display) is shown. In FIG. 1, FIG. 2 and FIG. 3, reference symbol K indicates cathodes which constitute electron sources, reference symbol KL indicates cathode lines, reference symbol G1 indicates first control electrodes, reference symbol G2 indicates second control electrodes (focusing electrodes), reference symbol AP indicates openings formed in the second control electrodes G2, reference symbol SUB1 indicates a back substrate, reference symbol G1L indicates first control electrode lines which supply electricity to the first control electrodes G1, reference symbol IS1 indicates a lower insulation layer, reference symbol IS2 indicates an upper insulation layer, and reference symbol TH indicates through holes which electrically connect the first control electrodes G1 and the first control electrode lines G1L. Here, reference symbol P1 indicates a first plane parallel to the back substrate SUB1, and reference symbol P2 indicates a second plane parallel to the back substrate SUB1.

The flat panel display device of this embodiment includes a plurality of cathode lines KL which extend in a first direction (y direction) and are arranged in parallel in a second direction (x direction) which intersects the first direction on the above-mentioned first plane P1 on a main surface of the back substrate SUB1, which is preferably made of glass. On the cathode lines KL, the electron sources, that is, the cathodes K are formed at positions where the respective pixels (color sub pixels in the case of a color display) are formed. Further, on the above-mentioned first plane P1, the first control electrodes G1 are arranged in parallel on the same plane as the cathode lines KL in a state such that the first control electrodes G1 sandwich at least a portion of the above-mentioned cathode K of the cathode line KL. The first control electrodes G1 are electrically connected with the first control electrode lines G1L, which are formed below the above-mentioned first plane P1 on the back substrate SUB1, by way of the lower insulation layer IS1 via the through holes TH which penetrate the lower insulation layer IS1.

Further, on the second plane P2, which is positioned above the first control electrodes G1 and is arranged parallel to the first plane P1, the second control electrodes G2 are arranged. The second control electrodes G2 are insulated from the first control electrodes G1 by the second insulation layer IS2, which is formed between the second control electrodes G2 and the first plane P1. Further, the second control electrodes G2 have openings AP at portions thereof which correspond to the above-mentioned respective pixels, and they are formed to cover the first control electrodes G1 from above. The openings AP have a size sufficient to expose the cathodes K and portions of the first control electrodes G1 arranged close to the cathodes K which are formed on the first plane P1. Here, the second insulation layer IS2 is formed such that portions thereof which correspond to the cathodes K and portions of the first control electrodes G1 arranged close to the cathodes K which are formed on the first plane P1 are excluded.

At intersecting portions between the cathode lines KL which have the cathodes K disposed thereon, and the first control electrode lines G1L, the electron beam sources are formed for respective pixels. The cathode lines KL have lead lines on at least one side of the periphery of the back substrate SUB1, while the first control electrode lines G1L, which are connected to the first control electrodes G1, have lead lines on at least another side of the periphery of the back substrate SUB1. A video signal voltage and a control voltage are respectively applied via these lead lines. Further, the second control electrodes G2 constitute so-called focusing electrodes, and a focusing voltage is applied to the second control electrodes G2 through lead lines (not shown in the drawing) arranged outside the display region of the face substrate.

In the structure of this embodiment, by applying the image signal voltage to the cathode lines KL and by applying the scanning signal voltage to the first control electrode lines G1L, electrons corresponding to the magnitude of the above-mentioned image signal voltage are taken out from the electron beam sources formed at the crossing portions between the cathode lines KL and the first control electrode lines G1L. The electrons which are taken out in this manner are subjected to a focusing action due to the focusing voltage applied to the second control electrode G2, and they are directed to the face panel due to the high voltage applied to the anode (anode electrode) provided on the face panel (not shown in the drawing) so as to excite the phosphors thereon and to make the phosphors emit light of given colors. According to this embodiment, the efficiency of use of the electron beams, when the electron beam sources adopting the IPG system are particularly used, is enhanced, whereby it is possible to obtain an image display of high brightness.

Figure 4:
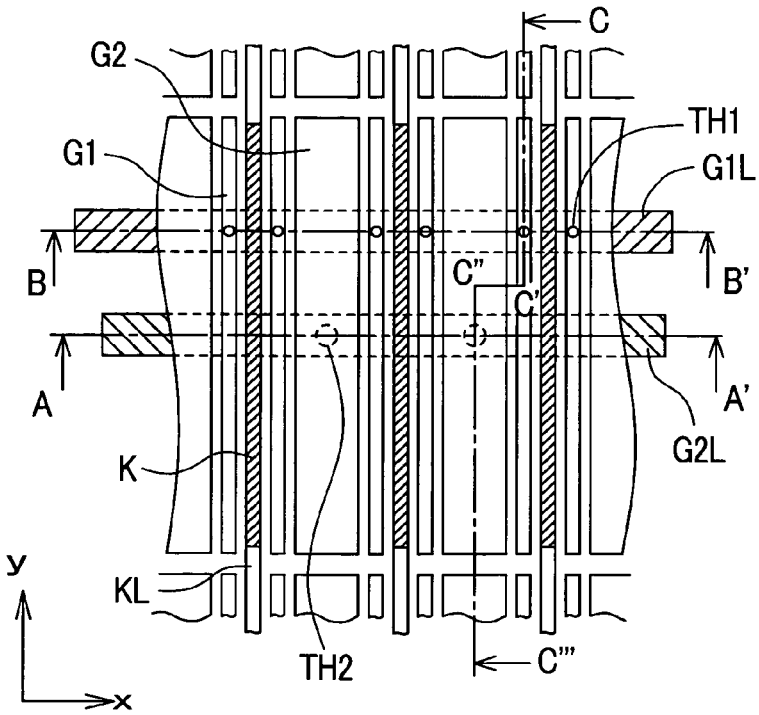
FIG. 4 is a diagrammatic plan view of a representative portion of a second embodiment of a flat panel display device according to the present invention.
Figure 5:
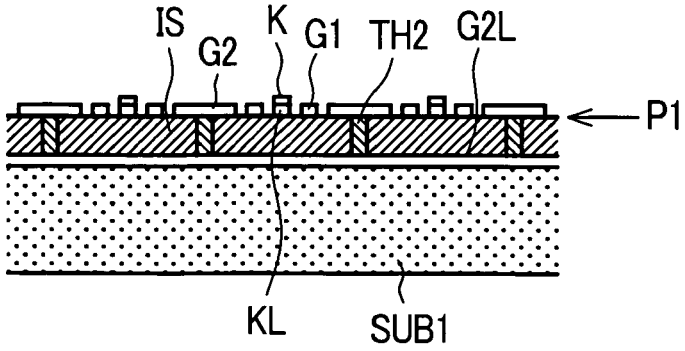
FIG. 5 is a cross-sectional view taken along a line A-A' in FIG. 4.
Figure 6:
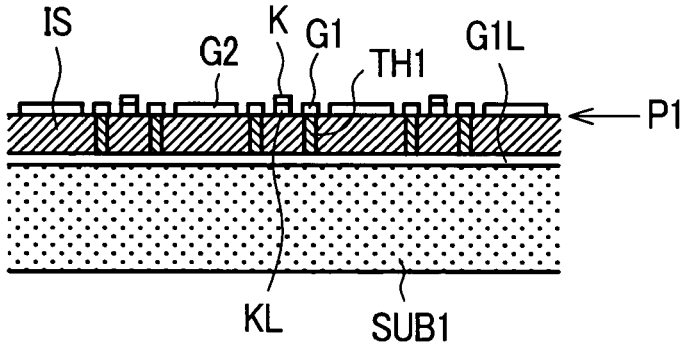
FIG. 6 is a cross-sectional view taken along a line B-B' in FIG. 4.
Figure 7:
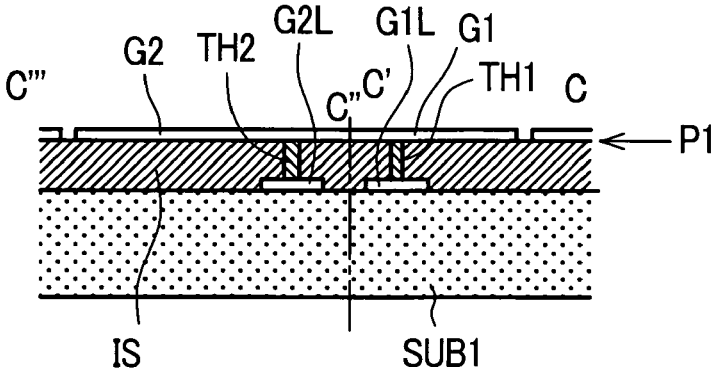
FIG. 7 is a cross-sectional view taken along a line C-C' and a line C"-C"' in FIG. 4.

FIG. 4 is a plan view of a second embodiment of a flat panel display device according to the present invention, FIG. 5 is a cross-sectional view taken along a line A-A' in FIG. 4, FIG. 6 is a cross-sectional view taken along a line B-B' in FIG. 4, and FIG. 7 is a cross-sectional view taken along a line C-C' and a line C"-C'" in FIG. 4. The chain line C' (C") in FIG. 7 corresponds to a C'-C" plane in FIG. 4. FIG. 4 to FIG. 7 show only the back panel, and the face panel is omitted. Reference symbols which are identical with reference symbols used in the drawing of the first embodiment correspond to identical functional portions.

The flat panel display device of this embodiment includes a plurality of cathode lines KL which extend in a first direction (y direction) and are arranged in parallel in a second direction (x direction) which intersects the first direction on the above-mentioned first plane P1 on a main surface of the back substrate SUB1, which is preferably made of glass. On the cathode lines KL, the electron sources, that is, the cathodes K, are formed at positions where the respective pixels (color sub pixels in the case of a color display) are formed. Further, on the above-mentioned first plane P1, the first control electrodes G1 are arranged in parallel on the same plane as the cathode lines KL in a state such that the first control electrodes G1 sandwich at least a portion of the above-mentioned cathodes K of the cathode line KL. The first control electrodes G1 are electrically connected with the first control electrode lines G1L which are formed below the above-mentioned first plane P1 on the back substrate SUB1 by way of the insulation layer IS via the first through holes TH1, which penetrate the insulation layer IS.

The second control electrodes G2 are formed on the same plane as the first plane P1. The second control electrodes G2 are arranged in a state such that the second control electrodes G2 sandwich the cathode line KL as well as the cathodes K thereon, and they are also arranged at positions where the second control electrodes G2 sandwich the electron beam source constituted of the first control electrodes G1 in the x direction. The second control electrodes G2 are connected with the second control electrode lines G2L, which are formed on the same plane on which the first control electrode lines G1L are formed, by way of the insulation layer IS via the second through holes TH2. Both control electrode lines are formed while ensuring a sufficient distance therebetween to prevent the second control electrode line G2L from coming into contact with the first control electrode lines G1L.

At intersecting portions between the cathode lines KL on which the cathodes K are disposed and the first control electrode lines G1L, the electron beam sources are formed for respective pixels. The cathode lines KL have lead lines on at least one side of the periphery of the back substrate SUB1, while the first control electrode lines G1L, which are connected to the first control electrodes G1, have lead lines on at least another side of the periphery of the back substrate SUB1. Further, it is desirable that the second control electrode lines G2L are provided with lead lines on a side of the periphery of the back substrate SUB1 opposite to the side where the lead lines of the first control electrode lines G1L are formed. A video signal voltage, a control voltage and a focusing voltage are respectively applied via these lead lines.

In this embodiment, three electrodes (the cathode lines KL, the first control electrodes G1, and the second control electrodes G2) can be simultaneously formed by one film forming operation using screen printing or the like; and, hence, the respective electrodes can be accurately arranged, and, at the same time, the manufacturing cost can be decreased. Due to the structure of this embodiment, by applying an image signal voltage to the cathode lines KL and by applying the scanning signal voltage to the first control electrode lines G1L, electrons corresponding to the magnitude of the above-mentioned image signal voltage are taken out from the electron beam source formed in the crossing portion between the cathode lines KL and the first control electrode lines G1L. The electrons which are taken out in this manner are subjected to a focusing action due to the focusing voltage applied to the second control electrode G2, and they are directed to the face panel due to the high voltage applied to the anode (anode electrode) provided on the face panel (not shown in the drawing) so as to excite the phosphors to make the phosphors emit light of given colors. According to this embodiment, it is possible to constitute a flat panel display device of the IPG type in which the focusing electrodes and the electron beam sources are formed on the same plane, and the efficiency of use of the electron beams is enhanced, whereby it is possible to obtain an image display of high brightness.

Figure 8:
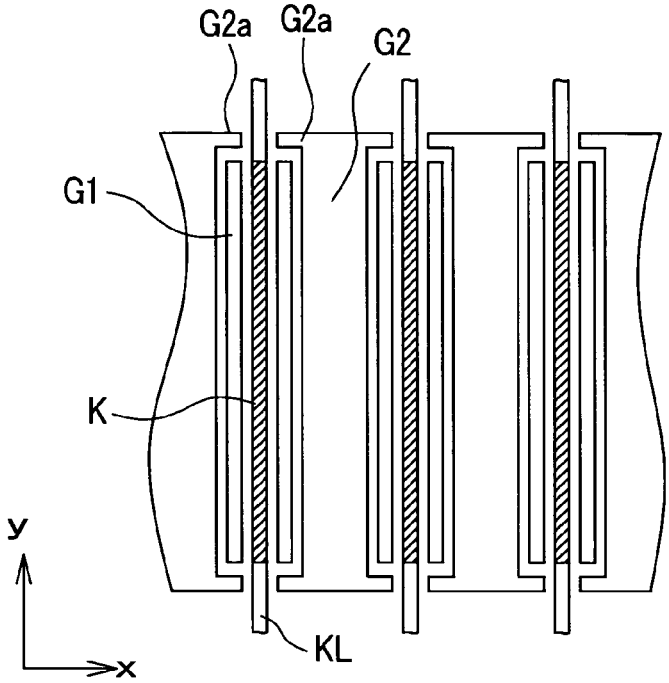
FIG. 8 is a diagrammatic plan view of a representative portion of a third embodiment of a flat panel display device according to the present invention.

FIG. 8 is a plan view showing a third embodiment of a flat panel display device according to the present invention, and it shows a state in which the cathode lines KL, the first control electrodes G1 and the second control electrodes G2 are arranged on the same plane of the back substrate in the same manner as the above-mentioned second embodiment. In this embodiment, the end portions G2*a* of the second control electrodes G2, which constitute the focusing electrodes, project in the x direction so as to surround the cathodes K on the plane. Due to such a constitution, it is possible to efficiently focus the electrons taken out from the cathodes K. Other constitutions and advantageous effects are similar to those of the second embodiment.

Figure 9:
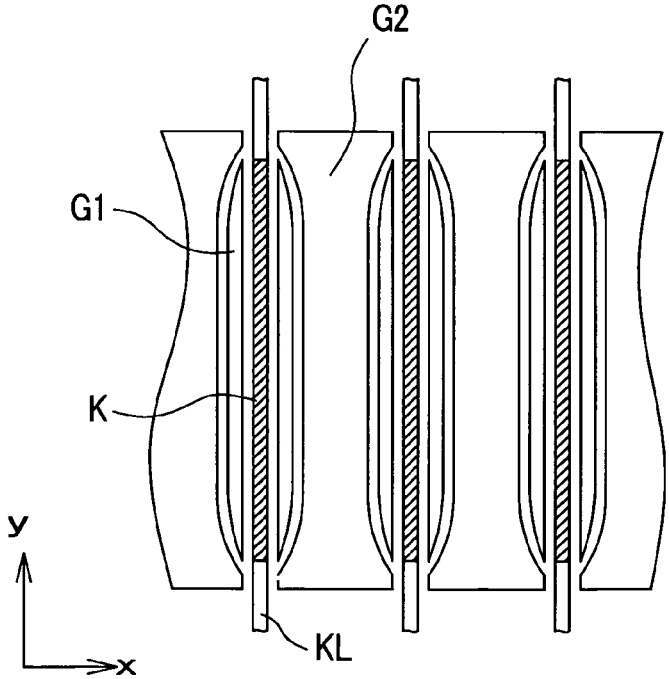
FIG. 9 is a diagrammatic plan view of a representative portion of fourth embodiment of a flat panel display device according to the present invention.

FIG. 9 is a plan view showing a fourth embodiment of a flat panel display device according to the present invention, and it shows a state in which the cathode lines KL, the first control electrodes G1 and the second control electrodes G2 are arranged on the same plane of the back substrate in the same manner as the above-mentioned second embodiment and third embodiment. In this embodiment, the first control electrodes G1 and the second control electrodes G2 are curved such that the first control electrodes G1 and the second control electrodes G2 assume a symmetrical relationship with respect to the extension direction (y direction) of the cathode K and are indented in the x direction, thus making the first control electrodes G1 and the second control electrodes G2 surround the cathode K on the plane. Due to such a constitution, it is possible to efficiently focus the electrons taken out from the cathodes K in the same manner as the third embodiment. Other constitutions and advantageous effects are similar to those of the second embodiment and the third embodiment.

Figure 10:
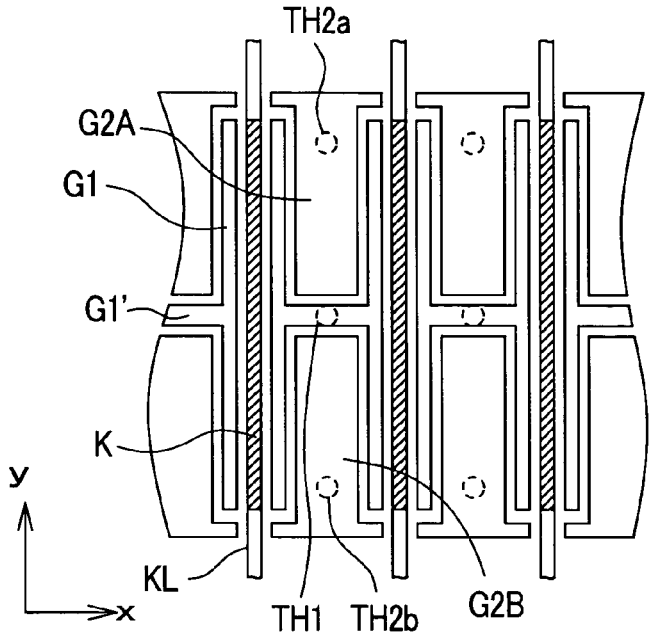
FIG. 10 is a diagrammatic plan view of a representative portion of a fifth embodiment of a flat panel display device according to the present invention.

FIG. 10 is a plan view showing a fifth embodiment of a flat panel display device according to the present invention. In the above-mentioned second, third and fourth embodiments, the in-plane width of the first control electrodes G1 becomes narrow, and, hence, the formation of the through holes which serve to connect the first control electrodes G1 and the first control electrode lines G1L, which are arranged on another layer (lower layer) of the back panel, is difficult. In the embodiment shown in FIG. 10, the second control electrode G2 of the third embodiment, which was explained in conjunction with FIG. 8, for example, is divided or split, for example, into a pair of second control electrodes G2A, G2B. Further, between the pair of second control electrodes G2A, G2B, the first control electrodes G1, which are arranged close to each other in the x direction, are connected to each other using an inter-control-electrode connection line (connection portion) G1'. By increasing the width in the y direction of the inter-control-electrode connection line (connection portion) G1', a through hole TH1 for connecting the first control electrode G1 and the first control electrode line, which is formed in the other layer, can be formed in such a portion.

To connect the second control electrodes G2 and the second control electrode lines arranged on the other layer of the back panel, through holes TH2*a*, TH2*b* are formed in the area of the divided second control electrodes G2A, G2B respectively. It is preferable to set the dividing position of the second control electrodes G2, on which the inter-control-electrode connection line G1' is formed, to the center portion in the y direction. Although the second control electrode may be chipped due to this division, so long as the center portion is chipped, the lowering of the focusing effect can be minimized. Also, according to this embodiment, it is possible to efficiently focus the electrons taken out from the cathodes K. Other constitutions and advantageous effects are similar to those of the second embodiment and the third embodiment.

Figure 11:
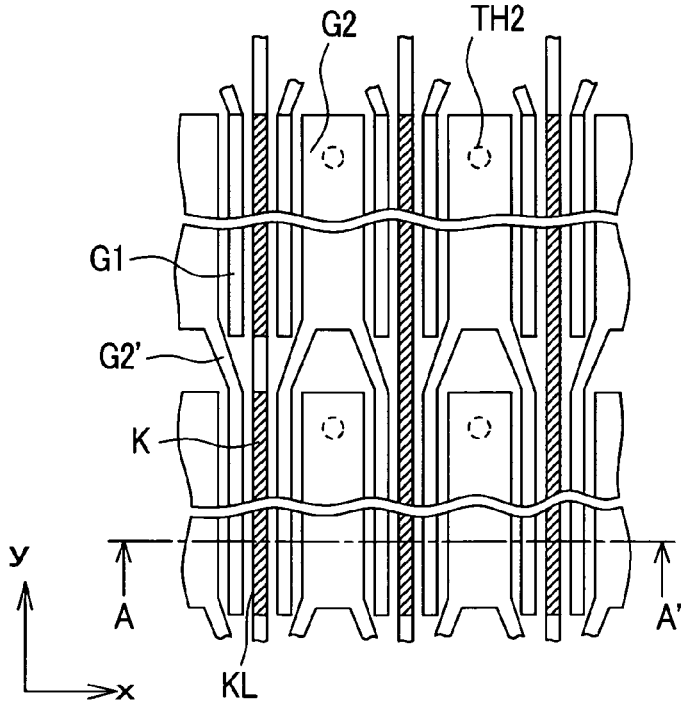
FIG. 11 is a diagrammatic plan view of a representative portion of a sixth embodiment of a flat panel display device according to the present invention.
Figure 12:
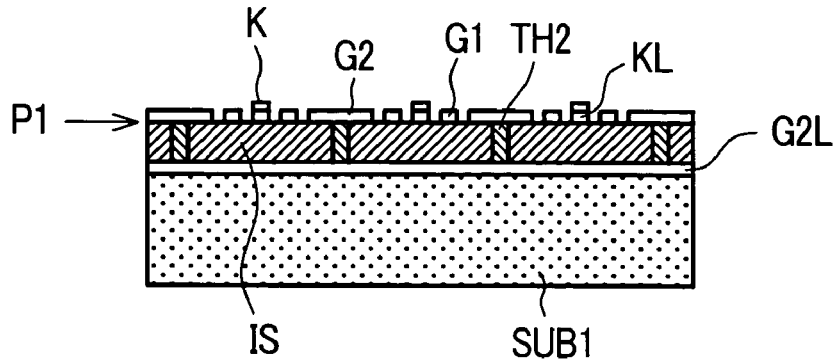
FIG. 12 is a cross-sectional view taken along a line A-A' in FIG. 11.

FIG. 11 is a plan view showing a sixth embodiment of a flat panel display device according to the present invention, and FIG. 12 is a cross-sectional view taken along a line A-A' in FIG. 11.

In this embodiment, the first control electrodes G1 and the second control electrodes G2 are formed in substantially the same manner as the planar constitution shown in FIG. 4, and a pair of the first control electrodes G1 are connected to the second control electrodes G2 of the pixel which is arranged close to the first control electrodes G1 in the y direction at a connection portion G2'. The second control electrodes G2 are connected with the second control electrode lines G2L formed on another layer of the back panel via the through holes TH2. That is, the first control electrode lines and the second control electrode lines are formed in common. Then, three voltages (ON voltage and OFF voltage of the first control electrode G1 and focusing voltage) are applied to the second control electrodes G2.

According to this embodiment, as shown in FIG. 12, the laminar structure of the back panel can be simplified; and, at the same time, since the power source circuit can be simplified, it is possible to achieve a reduction of the manufacturing cost and a simplifying of the drive circuit. Since other constitutions and advantageous effects are similar to those of the above-mentioned respective embodiments, their repeated explanation is omitted.

Figure 13:
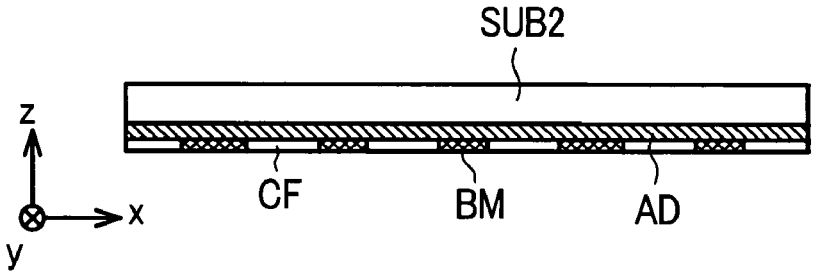
FIG. 13 is a cross-sectional view showing a structural example of a face panel used in the flat panel display device of the present invention.

FIG. 13 is a cross-sectional view showing a structural example of a face panel used in the flat panel display device of the present invention. The face panel is configured such that an anode AD is formed on a main surface (a face which faces the main surface of the back panel) of the face panel SUB2, which is preferably made of transparent glass; and, at the same time, phosphor stripes CF of three colors (red, green, blue), which are defined by a black matrix BM and extend in the y direction, are arranged in the x direction on the anode AD. Here, the anode AD may be formed over the phosphors.

Figure 14:
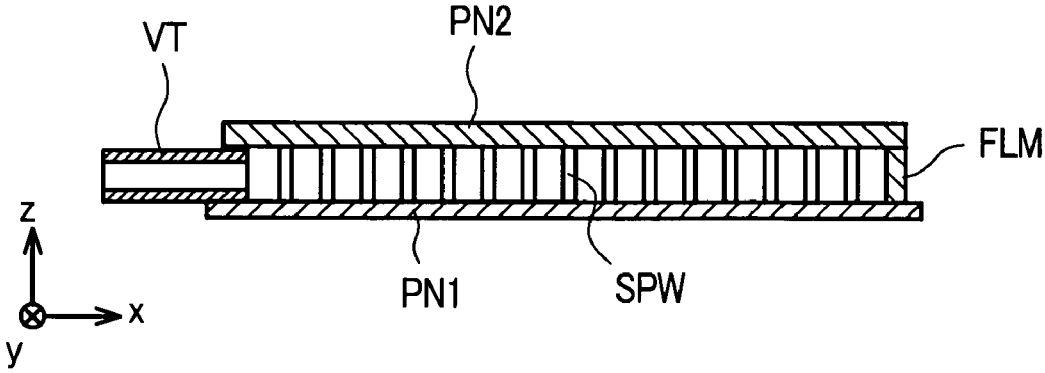
FIG. 14 is a cross-sectional view showing a constitutional example of the flat panel display device of the present invention.

FIG. 14 is a cross-sectional view showing an example of the flat panel display device of the present invention. In FIG. 14, a back panel PN1 and a face panel PN2 have respective main surfaces thereof face each other in an opposed manner. These panels are laminated to each other by interposing a sealing frame FLM in the periphery of a display region which is defined at center portions of the main surfaces. The inside of the sealed space is evacuated from an exhaust pipe VT and, thereafter, the exhaust pipe VT, is sealed to maintain a given degree of vacuum in the inside of the sealed space. The position of the exhaust pipe VT is not limited to the position shown in the drawing and may be formed, for example, on a corner (outside the display region and inside the sealing frame) of the back substrate.

Spacers SPW which define the distance to be maintained between the back panel PN1 and the face panel PN2, and, at the same time, which suppress the deflection of the respective substrates attributed to the vacuum pressure, are arranged at positions which do not obstruct the emission of electrons. The spacers SPW are preferably made of a glass plate or a ceramic plate and are arranged every three pixels (the pixel being a set consisting of one or a plurality of sub pixels). The back panel PN1, the face panel PN2 and the sealing frame FLM are fixed to each other using an adhesive material, such as frit glass.

In the above-mentioned respective embodiments, the electrodes and electrode lines formed on the back substrate SUB1, including the cathode lines K, the first control electrodes G1, the second control electrodes G2 and the like, are formed by screen printing, which uses a conductive paste preferably made of a silver paste. Further, it is also preferable to form respective insulation layers by screen printing. For example, the cathode lines KL are formed such that a cathode line KL has a thickness of 10 μm in the y direction and a width of 40 μm, and the distance between a cathode line KL and the adjacent first control electrode G1 is 20 μm. After baking the cathode lines KL by heating, on a region sandwiched by the first control electrodes G1 on the cathode lines KL, a paste containing approximately 10% by weight of carbon nanotubes, which are pulverized to a size of 1 μm or less, is printed, and, thereafter, the paste is baked by heating, thus forming the cathodes K. In the first embodiment, the film thicknesses of the cathode lines KL and the first control electrodes G1 are set to 10 μm. However, the thickness of the second control electrodes G2, which are formed in the succeeding step, is not limited to 10 μm.

On the other hand, in the second embodiment and ensuing embodiments in which the cathode lines KL, the first control electrodes G1 and the second control electrodes G2 are simultaneously formed on the same plane by screen printing, the thickness of the second control electrodes G2 is also set to 10 μm in the same manner as the cathode lines KL and the first control electrodes G1. Here, it is needless to say that these numerical values constitute merely an example, and the respective electrodes and the respective electrode lines can be formed with various values.

Due to the above-mentioned respective embodiments, it is possible to provide a flat panel display device which can realize sufficient electron emission with a low voltage, can use the extremely small control electrode current, can obtain a highly efficient electron emission, and can exhibit a large focusing effect.

Here, it is needless to say that the present invention is not limited to the constitutions explained in conjunction with the above-mentioned respective embodiments, and various modifications can be made without departing from the technical concept of the present invention.

What is claimed is:

1. A flat panel display device comprising:

a back panel having a back substrate;

a face panel having a face substrate; and a sealing frame which laminates peripheries of a display region formed at center portions of opposing faces of main surfaces of the back panel and the face panel and seals the inside of a lamination gap in a vacuum, wherein the flat panel display device further includes:

a plurality of electron beam sources which are constituted of a plurality of cathode lines which are formed on a plane parallel to the main surface of the back substrate, have cathodes, extend in the first direction and are arranged in parallel in the second direction which intersects the first direction;

first control electrodes which are arranged close to the cathode lines at least within the display region and control the takeout quantity of electrons from the cathodes; and second control electrodes which are positioned in the second direction with respect to the electron beam sources and operate to focus electron beams taken out from the electron beam sources in the direction toward the face panel, wherein the second control electrodes are constituted of a plurality of second control-electrode division electrodes which are divided in the first direction with respect to each electron beam source, and a first inter-control-electrode connection line which electrically connects the neighboring first control electrodes to each other in the second direction is provided between the divided second control-electrode division electrodes.

2. A flat panel display device according to claim 1, wherein the flat panel display device includes first control electrode lines which are formed on the main surface of the back substrate and below said plane by way of an insulation layer, and the first control electrodes are electrically connected with the first control electrode lines via first through holes which penetrate the insulation layer at portions of the first inter-control-electrode connection lines.

3. A flat panel display device according to claim 2, wherein the flat panel display device includes second control electrode lines which are formed on the main surface of the back substrate by way of the insulation layer, and the second control electrodes are electrically connected with the second control electrode lines via second through holes which penetrate the insulation layer and are electrically insulated from the first control electrode lines.

* * * * *